US008201595B2

(12) United States Patent
Trippi, Jr.

(10) Patent No.: US 8,201,595 B2
(45) Date of Patent: Jun. 19, 2012

(54) POUR SPOUT ASSEMBLY WITH WINGED STOP STRUCTURE

(76) Inventor: John Trippi, Jr., Morton Grove, IL (US)

( * ) Notice: Subject to any disclaimer, the term of this patent is extended or adjusted under 35 U.S.C. 154(b) by 892 days.

(21) Appl. No.: 12/286,423

(22) Filed: Sep. 30, 2008

(65) Prior Publication Data

US 2010/0078094 A1 Apr. 1, 2010

(51) Int. Cl.
*B65B 1/04* (2006.01)
*B67D 3/00* (2006.01)

(52) U.S. Cl. ..... 141/292; 141/285; 141/291; 141/352; 141/363; 141/366; 222/507; 222/522; 222/566

(58) Field of Classification Search ..... 141/350, 141/351, 352, 285, 364, 365, 363, 366, 2, 141/290, 291, 255, 353, 264, 296; 222/566, 222/484, 514, 513, 518, 522, 525, 567, 482, 222/507, 509

See application file for complete search history.

(56) References Cited

U.S. PATENT DOCUMENTS

| | | | | | |
|---|---|---|---|---|---|
| 2,953,634 | A | | 4/1952 | Vossburg | |
| 3,005,475 | A | | 10/1961 | Beall, Jr. | |
| 3,540,402 | A | * | 11/1970 | Kocher | 141/198 |
| 4,667,710 | A | * | 5/1987 | Wu | 141/198 |
| 4,834,151 | A | | 5/1989 | Law | |
| 4,958,668 | A | | 9/1990 | Vachon | |
| 5,000,360 | A | * | 3/1991 | Lown et al. | 222/521 |
| 5,076,333 | A | * | 12/1991 | Law | 141/198 |
| 5,107,909 | A | | 4/1992 | Donovan | |
| 5,228,487 | A | | 7/1993 | Thiermann et al. | |
| 5,234,038 | A | | 8/1993 | Mitchell et al. | |
| 5,249,611 | A | | 10/1993 | Law | |
| 5,419,378 | A | | 5/1995 | Law | |
| 5,704,408 | A | | 1/1998 | Law | |
| 5,762,117 | A | * | 6/1998 | Law | 141/198 |
| 6,227,419 | B1 | * | 5/2001 | Raboin | 222/484 |
| 6,435,380 | B1 | * | 8/2002 | Raboin | 222/484 |
| 6,478,058 | B1 | * | 11/2002 | Pears | 141/353 |
| 6,598,630 | B1 | * | 7/2003 | Trippi, Jr. | 141/350 |
| 6,668,393 | B1 | | 12/2003 | Mascari et al. | |
| 6,786,240 | B2 | | 9/2004 | Ouyoung | |
| 6,863,098 | B2 | | 3/2005 | Chrisco et al. | |
| 6,871,680 | B2 | | 3/2005 | Trippi, Jr. | |
| 6,889,732 | B2 | * | 5/2005 | Allen | 141/353 |
| 6,968,875 | B2 | * | 11/2005 | Nielsen | 141/351 |
| 7,013,936 | B2 | * | 3/2006 | Schliemann et al. | 141/353 |
| 7,073,686 | B2 | | 7/2006 | Hanell | |
| 7,124,917 | B2 | | 10/2006 | Lee | |
| 7,128,108 | B2 | * | 10/2006 | Nielsen | 141/351 |
| 7,708,211 | B2 | * | 5/2010 | Maier et al. | 239/456 |
| 2004/0035895 | A1 | * | 2/2004 | Schliemann et al. | 222/484 |
| 2007/0151990 | A1 | | 7/2007 | Garcia | |
| 2007/0210187 | A1 | * | 9/2007 | Maier et al. | 239/458 |

* cited by examiner

*Primary Examiner* — Timothy L Maust
(74) *Attorney, Agent, or Firm* — Meroni & Meroni, P.C.; Charles F. Meroni, Jr.; Christopher J. Scott

(57) ABSTRACT

A spout assembly transfers fluid from a container, and comprises a basic conduit construction, and a sleeve construction. The conduit construction comprises a laterally opposed extended conduit wings. The sleeve construction has a slotted end and a winged end. The slotted end comprises laterally opposed, bifurcated slots for receiving the conduit wings. Each bifurcated slot has an abbreviated and elongated slot length. The sleeve construction receives the conduit construction such that the sleeve construction is axially and rotatably displaceable relative to the conduit construction intermediate a closed position enabled via the conduit wings and abbreviated slot lengths and an open position enabled via the conduit wing and elongated slot lengths. The winged end comprises a plurality of circumferentially-spaced, extended wings, the longitudinal termini of which provide spout assembly stop structure at a fuel inlet aperture.

24 Claims, 18 Drawing Sheets

POUR SPOUT ASSEMBLY WITH WINGED STOP STRUCTURE

BACKGROUND OF THE INVENTION

1. Field of the Invention

The present invention generally relates to pour spouts for containers of fluid, and more particularly to a pour spout assembly that permits transfers of fluid (liquid) based on the influence of gravity and limits the tendency for fluid spills or overflow.

2. Description of the Prior Art

As stated in U.S. Pat. Nos. 6,598,630 and 6,871,680, it is desirable to avoid overfilling of fuel to internal combustion engines in lawnmowers, tractors, personal water craft, chain saws and power tools, outboard motors, all terrain vehicle (ATV) type recreational vehicles and even automobiles. Spilled fuel presents health and safety risks to people and the environment in general. As a result, many states have passed environmental legislation which regulates pour spouts which can be used in conjunction with volatile fuels and other liquids.

The opportunity for spills arises from various causes. First, often times the gas tanks in the aforementioned internal combustion engines have very narrow openings which requires precise pouring and/or a facilitating pour spout or funnel to prevent spills. Many times spills occur because the operator of the pour spout does not know when the receiving vessel is full. In these cases, overflows occur before pouring can be terminated.

Yet another cause of spills is the ineffective venting of the container from which the fluid is being transferred. The result of ineffective venting is an uneven fluid flow, and even in some cases surging of the fluid. Surges can cause splashing and an uneven flow makes it extremely difficult to predict fluid levels in the receiving vessel.

Another problem encountered by gravity influenced pour spouts is airlock caused by improper venting. Airlock occurs as a result of improper venting in combination with specific volume and viscosity parameters of the fluid being transferred. Such a condition can result in fluid which will not pour even when the container is inverted. This problem, while annoying, can normally be resolved by turning the container right side up again. However, this only increases the opportunity for spills.

Examples of prior spill-proof pour spouts include U.S. Pat. Nos. 4,598,743, 4,834,151, 5,076,333, 5,249,611, 5,419,378, 5,704,408, and 5,762,117. These pour spouts all have at least the following drawbacks: they do not provide multiple flow rate options and they do not provide childproof locks. Additionally, known pour spouts are limited in their compatibility with multiple vessel types, especially in light of certain state regulations requiring specific spout diameters for certain applications. For example, while some states may require spout outlet diameters on the order of 1 inch, that standard size diameter of a vehicular fuel tank inlet apertures is on the order of ¾ inch.

U.S. Pat. Nos. 6,598,630 and 6,871,680 essentially describe spill-proof pour spout(s) for transferring fluid from a first container to a second container or vessel. The pour spout(s) essentially comprise a base having an inner sleeve extending outwardly therefrom, a conduit member located in the inner sleeve, and an outer sleeve slidingly engaging the inner sleeve. The conduit member has a fluid tube, and air tube and an end cap. The outer sleeve is in a first closed position wherein the outer sleeve contacts the end cap preventing fluid flow from the pour spout.

The pour spouts are opened by rotating the outer sleeve to first or second indexing positions. By rotating the outer sleeve either clockwise or counterclockwise relative to the inner sleeve, the outer sleeve is adapted to be slid to either of two open positions permitting fluid to flow at either of two flow rate through the fluid tube and out of the pour spout. Said patents attempt to address concerns going to spillage and flow rates. The present invention further addresses these problems, as well as certain new problems that have come to light in view of regulatory changes.

In this last regard, it is noted that industry regulations changed in January of 2000 that no longer required standardized flow rates. The actual outlet end of the spout could thus be reduced for cooperative engagement within or adjacent a vehicular fuel intake aperture. It was contemplated, however, that certain accommodative stop structure would help guide and hold the narrowed spout outlet structure in cooperative engagement with a fuel inlet aperture.

SUMMARY OF THE INVENTION

Accordingly, the present invention attempts to structurally address the foregoing concerns and thus provides a spout assembly for transferring fluid from a container. The pour spout assembly essentially comprises a basic conduit construction, an insert construction, and a sleeve construction. The pour spout assembly further preferably comprises an end cap and a gasket type washer for improving function of the assembly.

The conduit construction has first and second inner conduit chambers, a winged end, an insert-receiving end, and a connector flange. The first and second inner conduit chambers are preferably separated by a substantially planar chamber-separating wall. The winged end comprises a pair of laterally opposed and radially extending wings. The connector flange is formed at the winged end and outfitted with the gasket type washer for attachment to a fuel container.

The insert construction comprises a substantially planar insert back, a channeled insert front, an outlet or fuel-dispensing end and an inlet or fuel-intaking end. The insert construction is insertable into the first conduit chamber such that the insert back is attached to the chamber-separating wall. The insert back is preferably angled toward the insert front at the dispensing end and thereby forms a guided air inlet and a guided fuel-fluid outlet.

The sleeve construction has a conduit-receiving inner surface, a slotted end, a ribbed or winged end, and two zones of differing diameter. The slotted end comprises a bifurcated slot for receiving the radial wings of the conduit construction. The bifurcated slot has an abbreviated slot length and an elongated slot length, whereby the abbreviated and elongated slot lengths are defined relative to one another.

The sleeve construction receives the conduit construction at the conduit-receiving inner surface such that the sleeve construction is axially and rotatably displaceable relative to the conduit construction intermediate (1) a closed position enabled by way of the cooperative engagement of the wing and abbreviated slot length and (2) an open position enabled by way of the cooperative engagement of the wing and elongated slot length.

The ribbed end of the sleeve construction and the dispensing end of the conduit insert (when in the closed position) cooperatively function to preventing fuel/fluid/matter from conducting through the first and second conduit chambers. Further, the ribbed end and the dispensing end (when in the open position) function to permitting fuel/fluid/matter to conduct intermediate the winged end and the dispensing end. The ribbed and dispensing ends are adapted or configured to prevent matter from conducting through the first and second chambers when in the closed position.

The slotted end of the sleeve construction essentially comprises a first sleeve diameter whereas the ribbed end comprises a second sleeve diameter lesser in magnitude relative to the first sleeve diameter. Extending radially from the second sleeve diameter is a plurality of circumferentially spaced ribs or wings substantially coextensive with the first sleeve diameter. The second sleeve diameter is preferably of a magnitude lesser than the diameter of a standard vehicular fuel inlet aperture, and certain longitudinal termini of the sleeve's ribs or wings providing spout assembly stop structure at the fuel inlet aperture.

Thus, the sleeve construction may be inserted into a typical vehicular fuel inlet and stopped by way of the wings. The longitudinal tips of the ribs or wings may be angled non-orthogonally relative to the second sleeve diameter for accommodating vehicular fuel inlet apertures of slightly varying dimensions. The spout assembly may further comprise a shoulder or claw, which circumferentially bridges a pair of adjacent ribs at or adjacent the longitudinal wing termini for enhancing spout assembly stop structure adjacent the vehicular fuel inlet aperture.

Other objects of the present invention, as well as particular features, elements, and advantages thereof, will be elucidated or become apparent from, the following description and the accompanying drawing figures.

BRIEF DESCRIPTION OF THE DRAWINGS

Other features of my invention will become more evident from a consideration of the following brief description of patent drawings:

FIG. 32(*a*) is an enlarged, fragmentary depiction of structure otherwise shown in FIG. 32 enlarged for clarity to show reference planes and angles of structural declination relative thereto.

DETAILED DESCRIPTION OF THE PREFERRED EMBODIMENT

Figure 1:
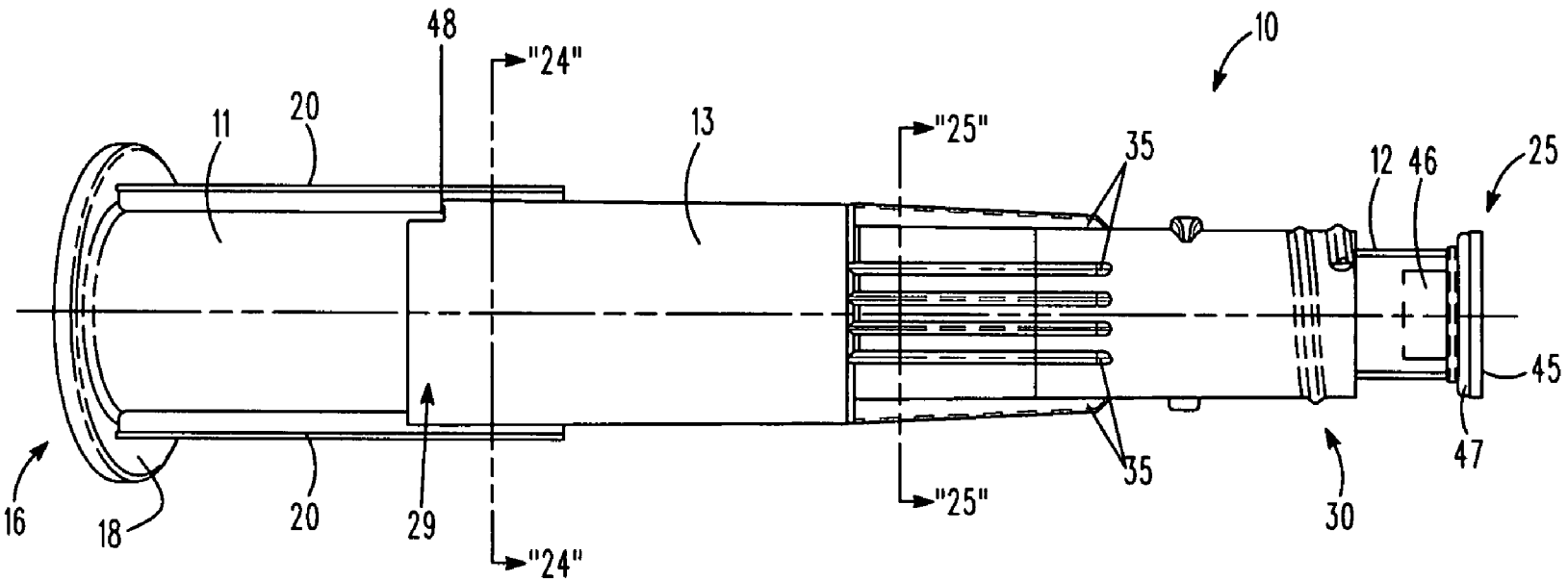
FIG. 1 is a top plan view of the pour spout assembly according to the present invention in an open position.
Figure 2:
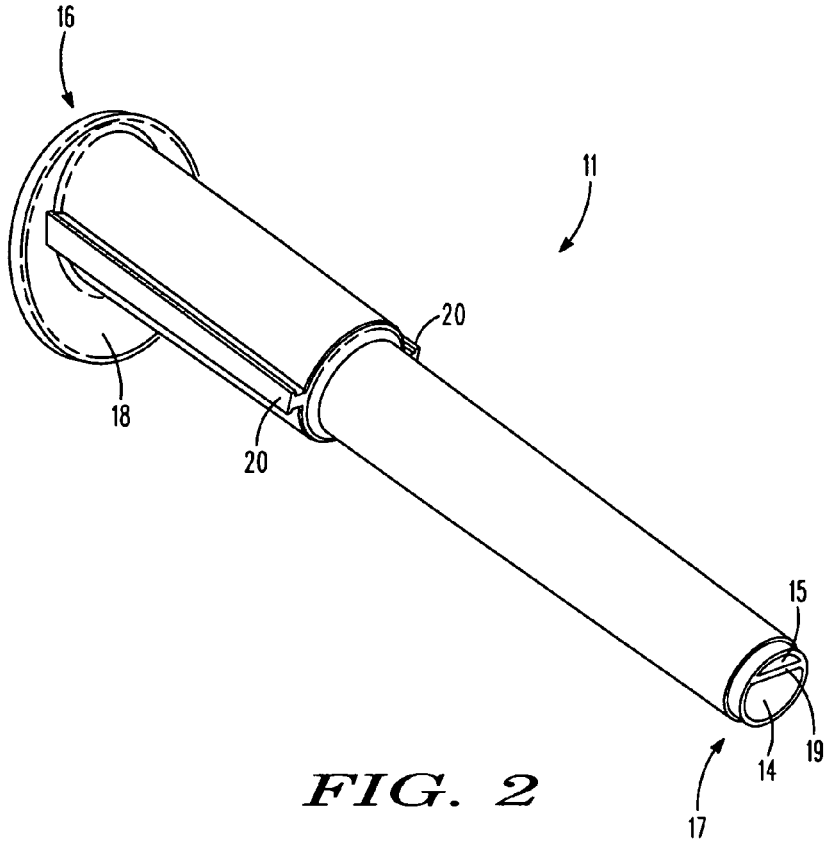
FIG. 2 is a top perspective view of a basic conduit construction or inner conduit member of the pour spout assembly.
Figure 3:
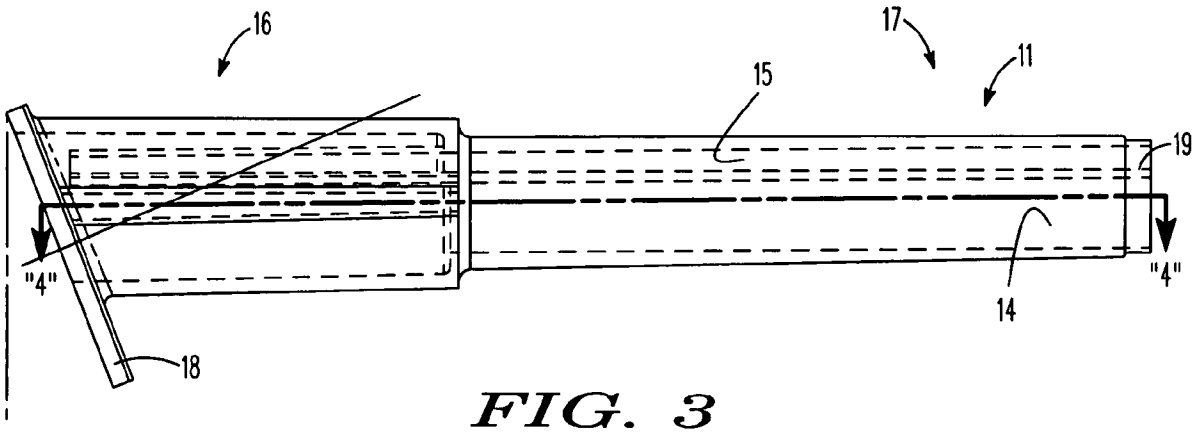
FIG. 3 is a lateral view of the basic conduit construction having broken lines to show otherwise hidden detail.
Figure 4:
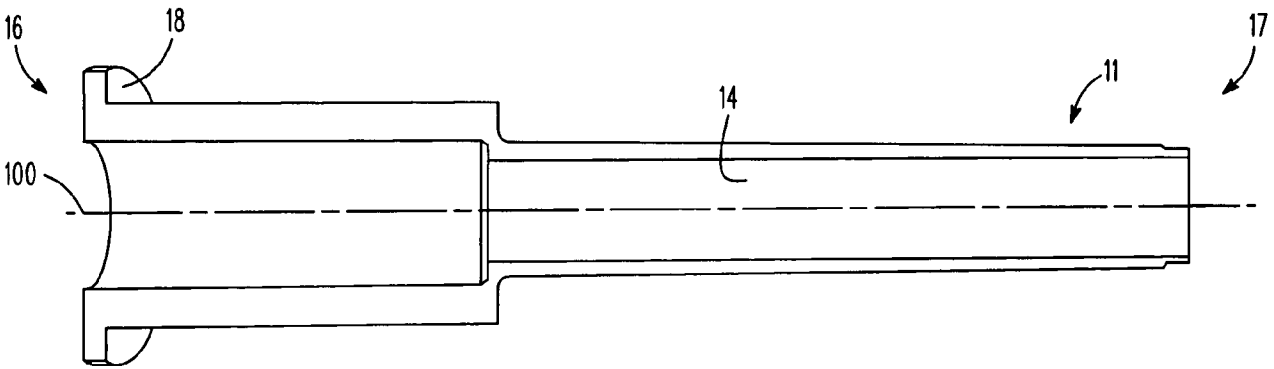
FIG. 4 is a longitudinal sectional view of the basic conduit construction as sectioned from FIG. 3 along plane '4-4'.
Figure 5:
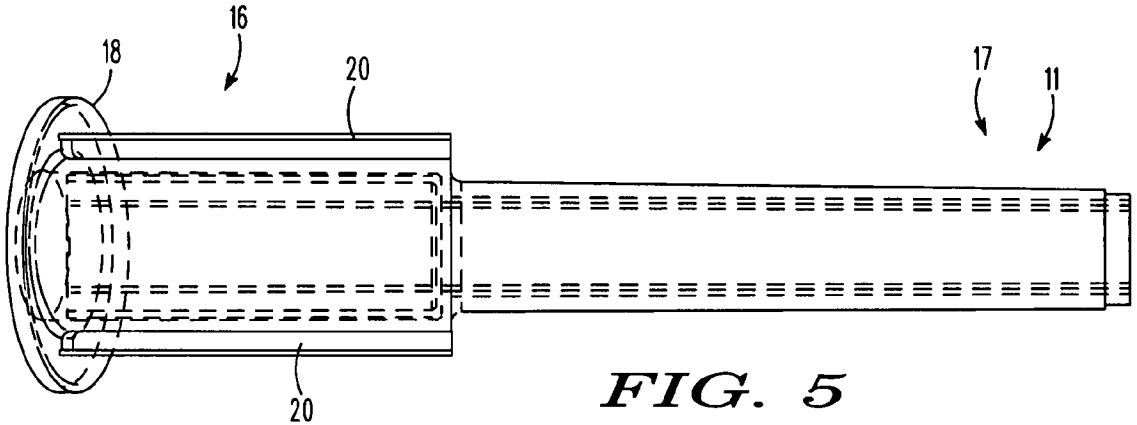
FIG. 5 is a top plan view of the basic conduit construction having broken lines to show otherwise hidden detail.
Figure 6:
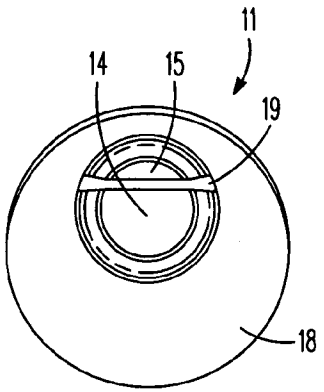
FIG. 6 is a plan type end view of the basic conduit construction showing a connector flange, and first and second internal conduit chambers.
Figure 7:
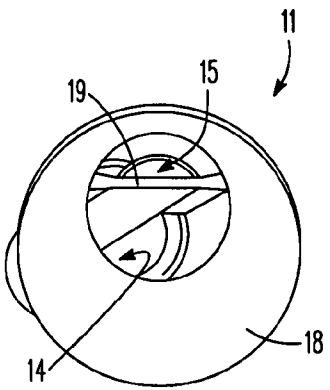
FIG. 7 is a perspective type end view of the basic conduit construction showing the connector flange, and the first and second internal conduit chambers.
Figure 8:
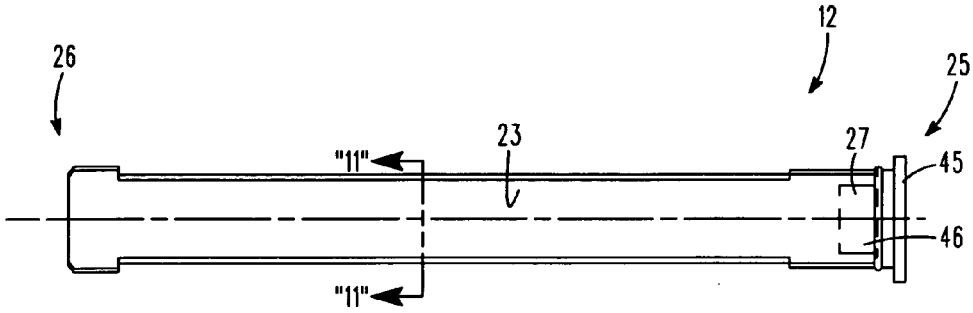
FIG. 8 is a top plan view of an insert construction or conduit insert of the pour spout assembly.
Figure 9:
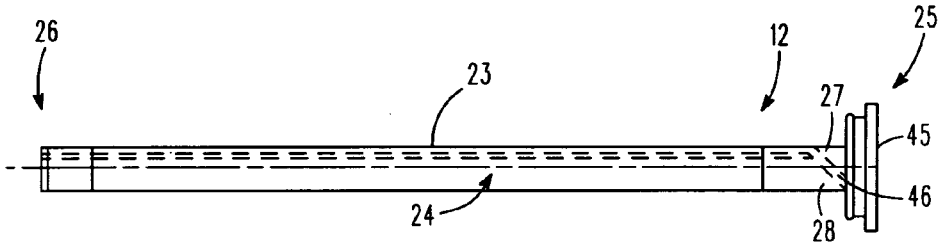
FIG. 9 is a lateral view of the insert construction of the pour spout assembly having broken lines to show otherwise hidden detail.
Figure 10:
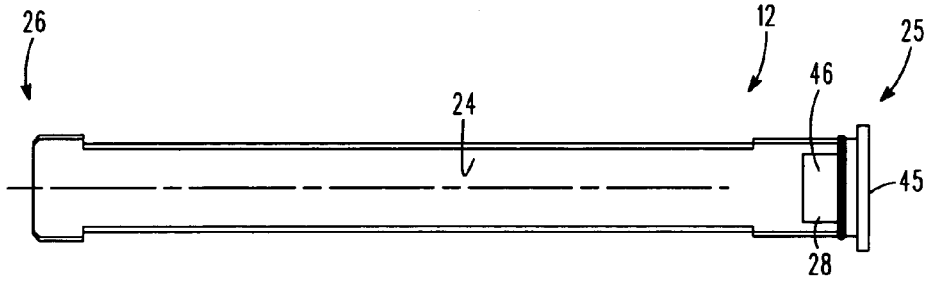
FIG. 10 is a bottom plan view of the insert construction of the pour spout assembly.

Referring now to the drawings with more specificity, the preferred embodiment of the present invention concerns a pour spout assembly 10 for transferring fluid from a first fluid container into a second fluid container or vessel. It is contemplated, for example, the spout assembly may be attached to typical fuel container for transferring fuels from manually carried fuel containers into the fuel tanks of automobile type vehicles, all terrain vehicle (ATV) type recreational vehicles, lawnmowers, tractors, personal water craft, chain saws and/or similar other power tools, and outboard motors to name a few representative examples.

In other words, when hereafter describing the functionality of the pour spout assembly 10 according to the present invention, it should be presumed that the pour spout assembly 10 is attached to a fluid-filled container, such as, for example, a gasoline container, and a user of the pour spout assembly 10 is attempting to transfer fluid from the container to a receiving vessel (having a fuel inlet aperture and surrounding aperture-defining structure) into which the pour spout assembly 10 can be inserted.

Figure 31:
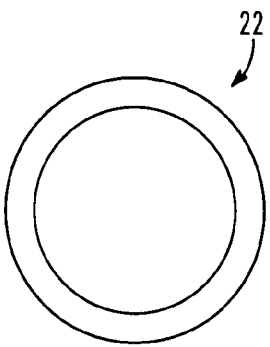
FIG. 31 is an axial view of the gasket type washer of the pour spout assembly, which washer cooperates with the connector flange for improving the seal at the assembly-container junction site.
Figure 30:
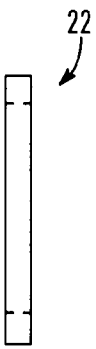
FIG. 30 is a side view of a gasket type washer of the pour spout assembly having broken lines to show otherwise hidden detail (inner radius).
Figure 29:
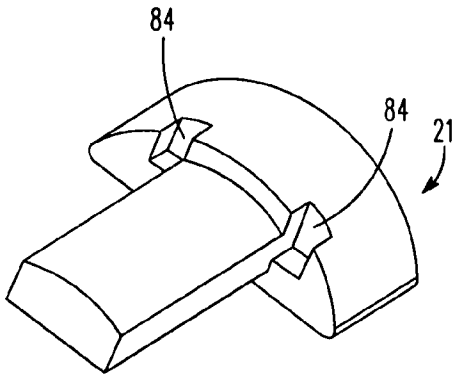
FIG. 29 is a top perspective view of the vent cap showing laterally opposed air vents.
Figure 26:
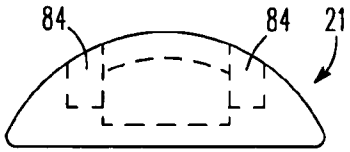
FIG. 26 is an end view of a vent cap of the pour spout assembly having broken lines to depict otherwise hidden detail.
Figure 27:
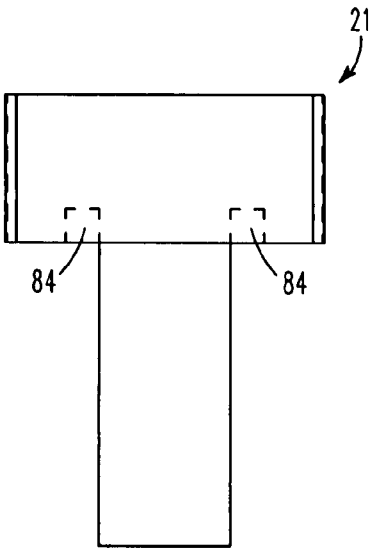
FIG. 27 is a bottom plan view of the vent cap having broken lines to depict otherwise hidden detail (air vents).

The spout assembly 10 preferably comprises a basic conduit construction or conduit member 11 as generally illustrated and referenced in FIGS. 2-7; an insert construction or conduit insert 12 as generally illustrated and referenced in FIGS. 8-13; and a sleeve construction or conduit sleeve 13 as generally illustrated and referenced in FIGS. 14-17. Further components include an air vent cap 21 as generally illustrated and referenced in FIGS. 26-29, a gasket type washer 22 as generally illustrated and referenced in FIGS. 30 and 31, and a biasing member, such as a compression coil (as at 42) or similar other spring means, or an elastomeric member or material as at 43.

The conduit construction or basic conduit member 11 is preferably constructed from high density polyethylene and further preferably comprises a first inner conduit chamber 14, a second inner conduit chamber 15, a winged end 16, an insert-receiving end 17, and a connector flange 18. The first and second inner conduit chambers 14 and 15 are separated by a substantially planar, chamber-separating wall 19. The winged end 16 comprises at least one, but preferably a pair of laterally opposed, radially extending wings 20. The connector flange 18 extends radially in a flange plane that is preferably integrally formed at the winged end 16 such that the flange plane is non-orthogonal to the axis 100 of the conduit member 11 as perhaps best reflected in FIGS. 3 and 4.

Figure 11:
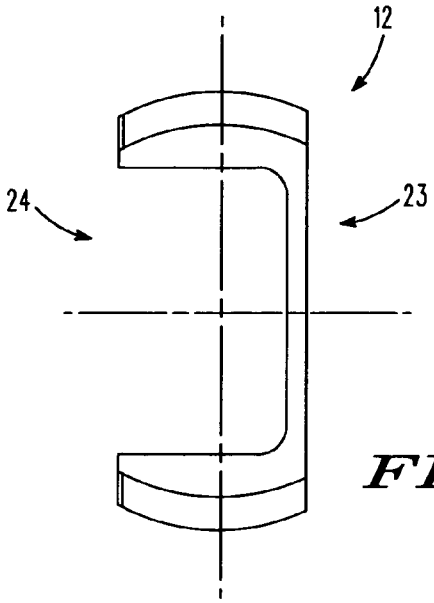
FIG. 11 is a transverse sectional view of the insert construction as taken along plane '11-11' showing a substantially U-shaped cross section.

The insert construction or conduit insert 12 is preferably constructed from high density polyethylene and is received by the conduit member 11 within the first conduit chamber 14 and generally comprises a U-shaped transverse cross-section as generally depicted in FIG. 11. Having such a transverse cross-section, the insert construction of conduit insert 12 preferably comprises a substantially planar insert back 23, a channeled insert front 24, a fuel/fluid-dispensing end 25 and a fuel/fluid-inletting end 26.

The insert construction or conduit insert 12 is insertable into the first conduit chamber 14 such that the insert back 23 is attached to the chamber-separating wall 19. The outer surfaces of the insert back 23 and the channeled insert front 24 are preferably angled toward the insert front 24 at the dispensing end 25 thereby forming an air inlet 27 at the surface of the insert back 23 and a fuel/fluid outlet 28 at the surface of the channeled front 24.

The sleeve construction or conduit sleeve 13 is preferably constructed from high density polyethylene and is sized and shaped to receive the conduit member 11 and preferably comprises a slotted end 29 and a threaded end 30. The threaded end 30 may be outfitted with a threaded cap (not specifically shown) from protecting same. The slotted end 29 comprises at least one, but preferably a pair of laterally opposed, bifurcated slots 31 for receiving the wings 20. The bifurcated slots 31 each preferably comprise an abbreviated slot length as at 32 and an elongated slot length as at 33. From an inspection of FIG. 17, for example, it may be seen that the abbreviated and elongated slot lengths 32 and 33 may be defined relative to one another.

The slotted end 29 preferably comprises a first sleeve diameter and the threaded end 30 preferably comprises a second sleeve diameter, the second sleeve diameter being lesser in magnitude relative to the first sleeve diameter (and outer surfaces thereof). In other words, at portion 34 in FIGS. 16 and 17, the sleeve construction 13 is reduced in diameter if moving left to right. A plurality of circumferentially spaced ribs or wings 35 extend longitudinally from the portion 34 such that the outer edges or transverse termini 36 of the wings 35 define a diameter substantially equal in magnitude to the first sleeve diameter at the portion 34.

Figure 22:
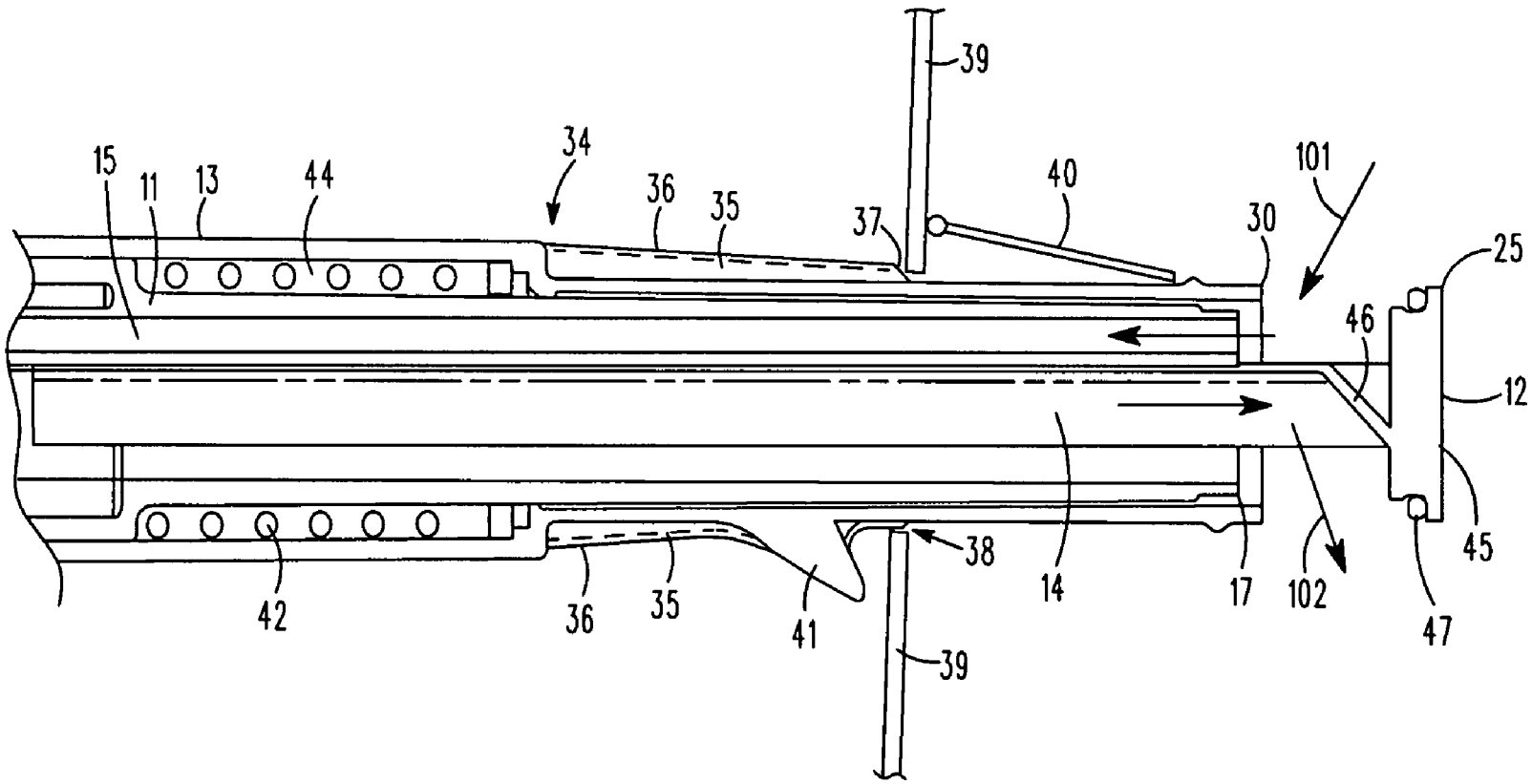
FIG. 22 is a first enlarged, fragmentary, longitudinal sectional view of the pour spout assembly as sectioned through a sagittal plane showing the pour spout assembly in an open position and showing sleeve wings of the sleeve construction providing stop structure as engaged with a simplistic, vehicular fuel inlet assembly.
Figure 23:
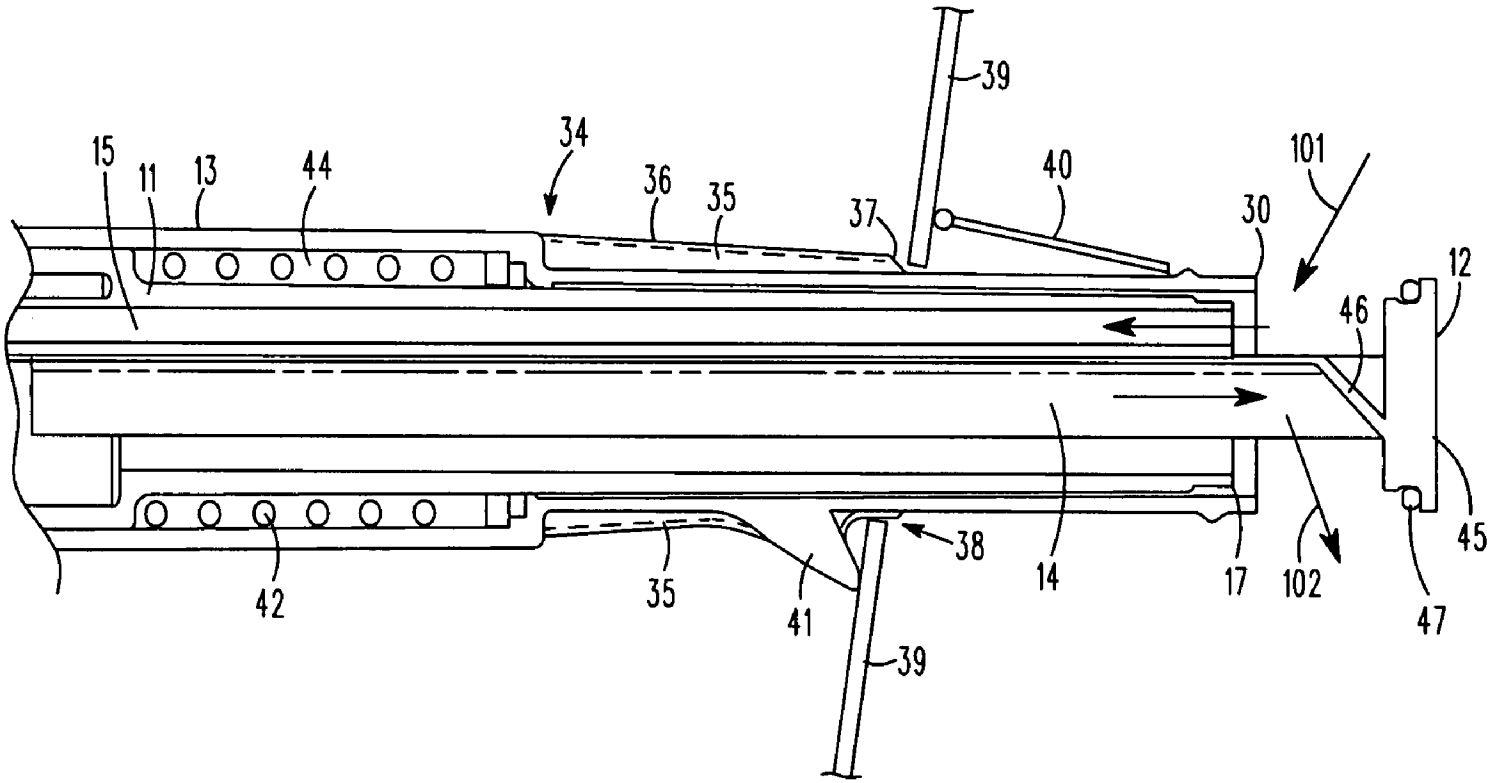
FIG. 23 is a second enlarged, fragmentary, longitudinal sectional view of the pour spout assembly as sectioned through a sagittal plane showing the pour spout assembly in an open position and showing sleeve wings and the sleeve shoulder the sleeve construction providing stop structure as engaged with a simplistic, vehicular fuel inlet assembly.
Figure 25:
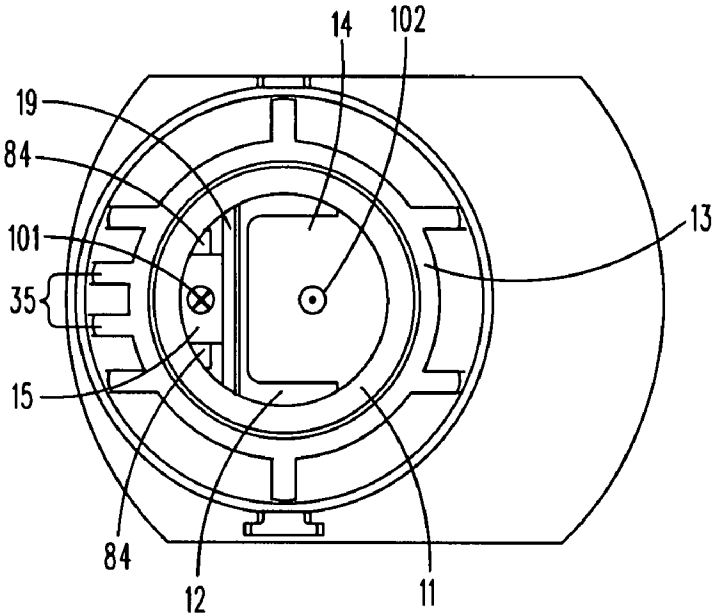
FIG. 25 is a transverse sectional type view of the pour spout assembly as sectioned along plane '25-25 in FIG. 1.
Figure 24:
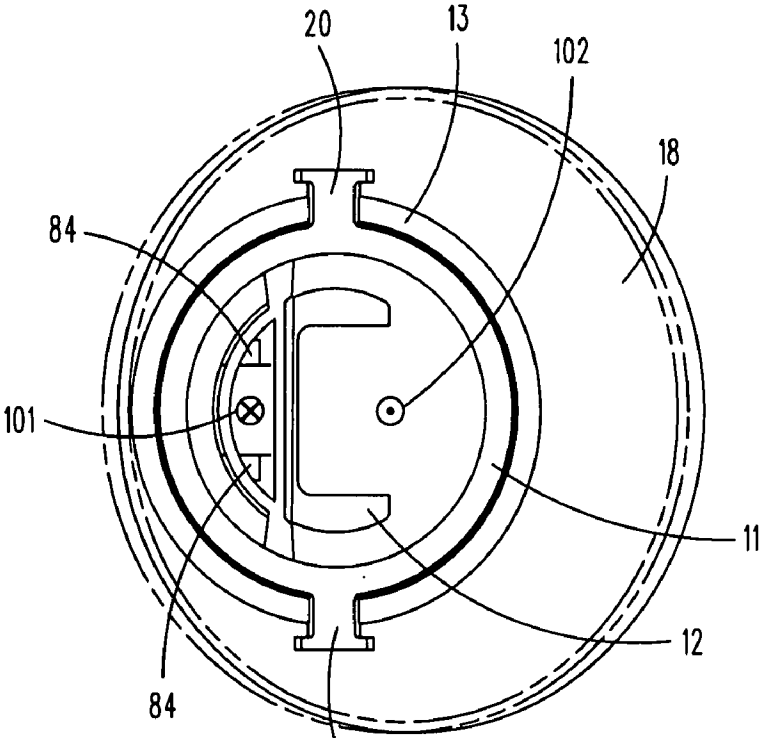
FIG. 24 is a transverse sectional type view of the pour spout assembly as sectioned along plane '24-24' in FIG. 1.
Figure 28:
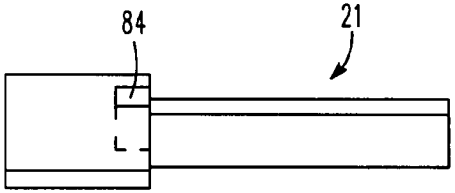
FIG. 28 is a lateral plan view of the vent cap having broken lines to depict a lower portion of otherwise hidden detail (air vent).

The longitudinally extending ribs or wings 35 further comprise longitudinal termini as at 37, which are preferably sloped from the transverse termini 36 toward the second sleeve diameter (or outer surface thereof). The longitudinal termini 37 essentially function to provide spout assembly stop structure at a vehicular fuel inlet aperture as at 38 in FIGS. 22 and 23. The vehicular fuel inlet aperture is formed in an inlet barrier 39 and is otherwise closed or covered by a fuel inlet aperture door 40 movably connected to the barrier 39.

The insert-receiving end 17, the dispensing end 25, and the threaded end 30 are insertable through the fuel inlet aperture 38 and the termini 37 function to stop the assemblage for further progressing into the region beyond aperture 38. The wings 35 thus provide circumferentially spaced stop structure adjacent vehicular type fuel inlet apertures, which are of standard size and shape with a ¾ inch diameter.

These apertures 38, however, are not perfectly uniform, the diameters/dimensions differing slightly due to manufacturing discrepancies and/or wear over the lifetime of the structure. The sloped termini 37 are believed to accommodate variously sized apertures 38, the lower portions of the slopes accommodating smaller diameters and the upper portions of the slopes accommodating larger diameters. The radial termini 37 of the wings 35 of the conduit sleeve or sleeve construction 13 may thus coact with the barrier 39 to permit the sleeve construction 13 to slide relative to the conduit construction into an open position when force is applied to the spout assembly 10 by the user.

It will be recalled that the pour spout assembly 10 may preferably comprise certain biasing means, such as may be defined by a compression coil 42 or an elastomeric member or material 43. Such biasing means may be structurally located in the cavity 44 formed intermediate the outer sleeve construction 13 and the inner conduit construction 11. In this regard, it should be noted that the sleeve construction 13 engages the conduit construction 11 and is held in a normally closed position by certain biasing means, such as a spring or coil 42 or elastomeric member or material 43.

In the normally closed position, the sleeve construction 13 is biased against an end cap 45 (of the dispensing end 25 of the insert construction 12) by the biasing means, thereby preventing flow through the conduit construction 11. The end cap 45 may be preferably outfitted with an O-ring type gasket as at 47 for improving the seal at the dispensing end 25 when in the closed position. It is contemplated that the O-ring type gasket 47 may be preferably constructed from an elastomeric material so as to enable compression thereof. In a relaxed state, the O-ring type gasket 47 has a transverse thickness on the same order of magnitude as the lock stop tab 48 formed as part of the bifurcated slots 31.

Figure 17:
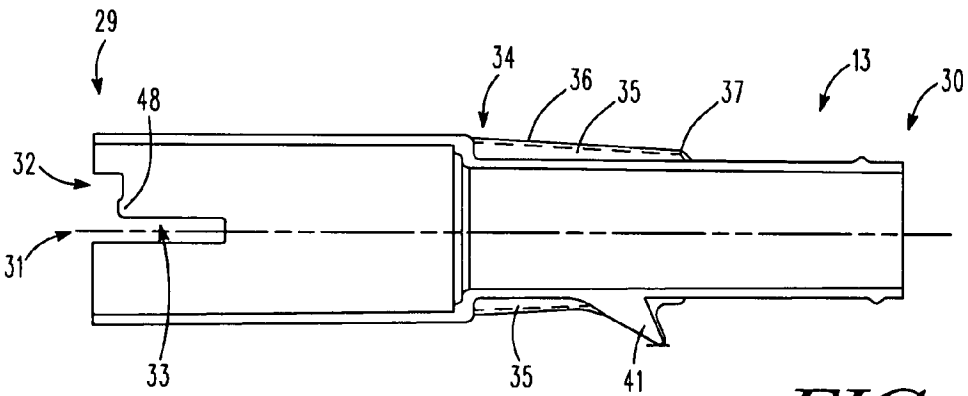
FIG. 17 is a longitudinal sectional view of the sleeve construction as taken along plane '17-17' in FIG. 16 and showing a bifurcated slot at the slotted end, and an upper wing and a shoulder at the winged portion.
Figure 18:
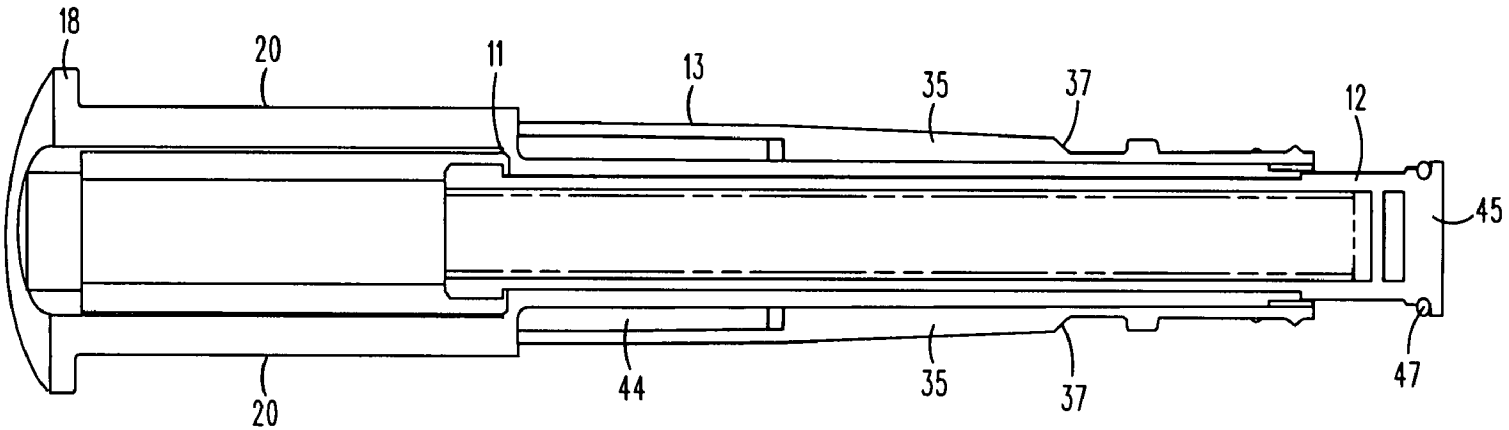
FIG. 18 is a longitudinal sectional view of the pour spout assembly as sectioned through a laterally extending frontal plane with the conduit, insert, and sleeve constructions in assembled relation and the pour spout assembly in an open position.
Figure 19:
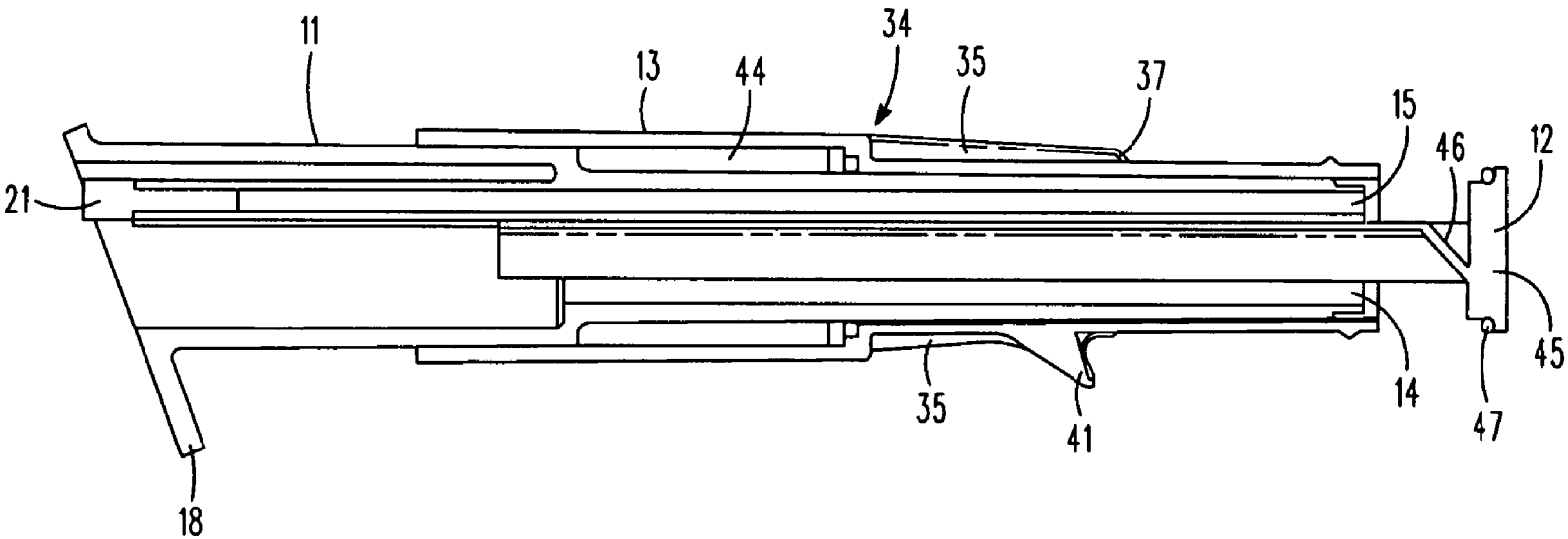
FIG. 19 is a longitudinal sectional view of the pour spout assembly as sectioned through a sagittal plane with the conduit, insert, and sleeve constructions in assembled relation and the pour spout assembly in an open position.

In this last regard, it may be noted from an inspection of the figures, and FIG. 17 in particular, that the lock stop tabs 48 function to prevent the wings 20 from freely passing into the long portion of the slot(s) 31 from the short portion of the slot(s). In other words, if the user so desires, he or she may lock the pour spout assembly, by placing the wings 20 into the short portions of the slot(s), and the lock stop tab(s) 48 function to prevent movement of the wings therefrom. If the O-ring type gasket 47 is removed, however, the wings 20 may freely move (upon sleeve rotation relative to the conduit) into either the short or long portion of the slots 31. The compressive nature of the gasket 47 allows the wings 20 to pass the tabs 48 during rotation.

Figure 14:
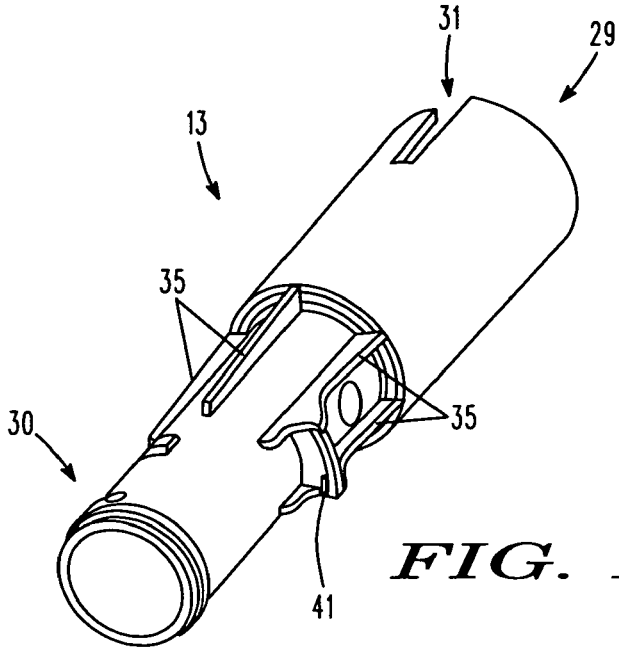
FIG. 14 is an end perspective view of a sleeve construction or conduit sleeve of the pour spout assembly as viewed from a threaded end thereof.
Figure 15:
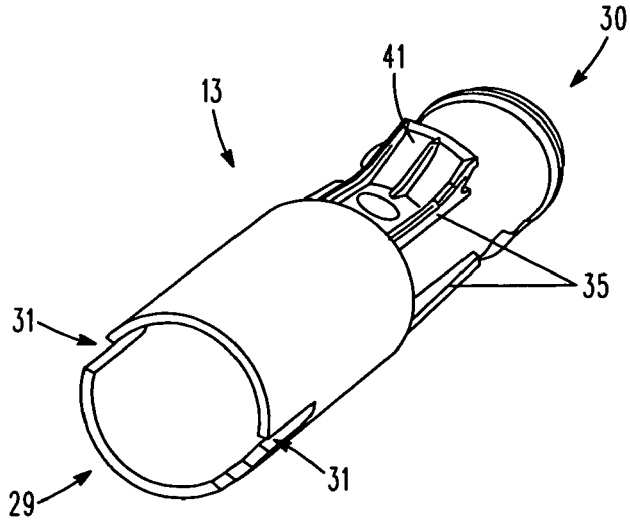
FIG. 15 is an end view of the sleeve construction as viewed from a slotted end thereof.
Figure 16:
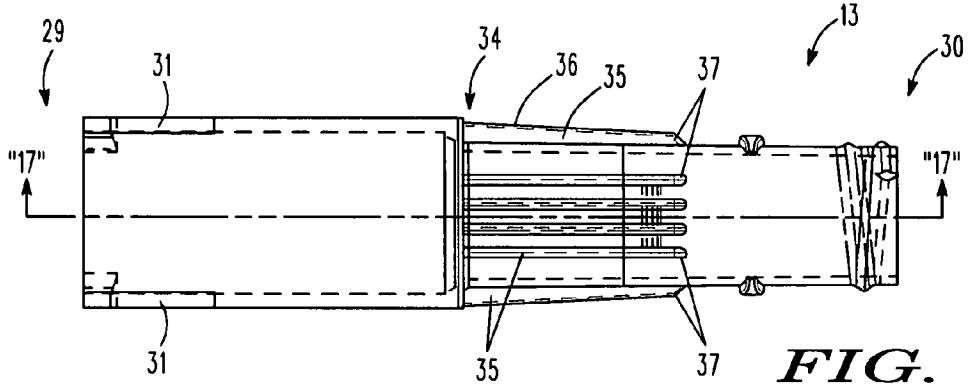
FIG. 16 is a top plan view of the sleeve construction showing laterally opposed slots formed at the slotted portion or slotted end and a plurality of circumferentially spaced wings formed at the winged portion thereof.

It is noted, however, that not all fuel/fluid inlet openings are standardized to ¾ inch. Most fuel/fluid inlet openings are of larger dimension, and thus the sleeve construction 13 may further comprise a shoulder 41. The shoulder 41 bridges adjacent wings 35 at the bottom portion of the sleeve construction 13 as generally depicted in FIGS. 14 and 15. The shoulder 41 of the conduit sleeve or sleeve construction 13 may thus also coact with the receptacle of the receiving vessel to permit the sleeve construction 13 to slide relative to the conduit construction into an open position when pressure is applied to the spout assembly 10 by the user.

As indicated, the sleeve construction or conduit sleeve 13 receives the conduit construction or conduit member 11 such that the sleeve construction is axially displaceable and rotatable relative to the conduit construction 11 intermediate (1) a closed position enabled by the cooperative receipt of the wings 20 in the abbreviated slot lengths 32 and (2) an open position enabled by the cooperative receipt of the wings 20 in the elongated slot lengths 33. In other words, the outer conduit sleeve 13 is rotatable intermediate the short and long portions of the slots 31 and slidably moveable (with respect to the inner conduit member 11) while in the long portion of the slots 31.

The vent cap 21 is sized and shaped to be received in the second conduit chamber 15 adjacent the fuel/fluid-inletting end 26. The vent cap 21 comprises at least one, but preferably laterally opposed vents 84 for venting air otherwise passing from the fuel/fluid-dispensing end 25 toward the winged end 16 as generally depicted and referenced at vectors 101 in FIGS. 22-25.

When in an open position, air flow 101 enters at the dispensing end 25 and flows via the second conduit chamber 15 toward the winged end 16. Air vents 84 allow the air flow 101 to exit the second conduit chamber 15. Fuel/fluid flow (as at vectors 102) is generally opposite that of the air flow 101 as generally depicted in FIGS. 22-25. It should be noted how the angled portion 46 of the insert construction 12 adjacent the dispensing end 25 helps guide or direct fuel/fluid flow 102 as it exits the first conduit chamber 14.

In other words, the second conduit chamber 15 and the first conduit chamber 14 of the conduit member 11 are exposed to the ambient atmosphere. Air flow 101 enters adjacent the air inlet 27 and is directed through the second conduit chamber 15 and exits the through the vents 84. Simultaneously, fuel/fluid is allowed to freely flow from the container through the first conduit chamber 14 and out the fuel/fluid outlet 28 adjacent the dispensing end 25 as a result of a pressure differential between the atmosphere and the pressure developed in the container. This structural arrangement also allows for an even air to fluid volume displacement resulting in an even rate of fluid flow.

The gasket type washer 22 preferably comprises a U-shaped transverse cross-section (not specifically illustrated) and functions to cover the outer rim of the connector flange 18. Together the washer 22 and flange 18 cooperate with a threaded collar of a container (not specifically illustrated) to facilitate connection of the pour spout assembly 10 to the container, and to prevent fuel/fluid leakage at the junction of the flange 18 and container.

Figure 20:
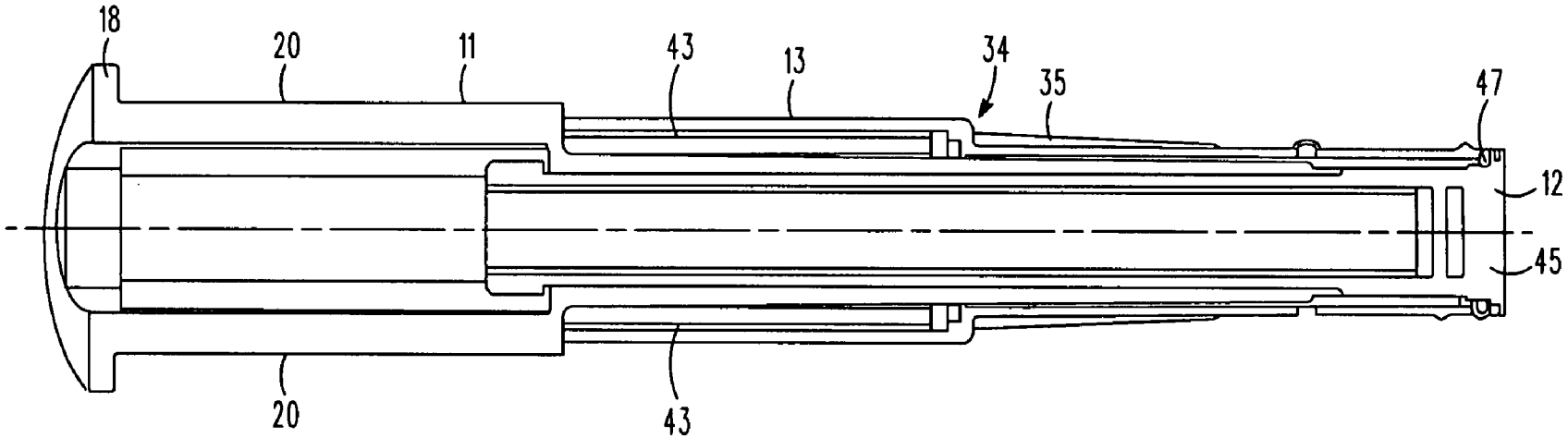
FIG. 20 is a longitudinal sectional view of the pour spout assembly as sectioned through a laterally extending frontal plane with the conduit, insert, and sleeve constructions in assembled relation and the pour spout assembly in a closed position.
Figure 21:
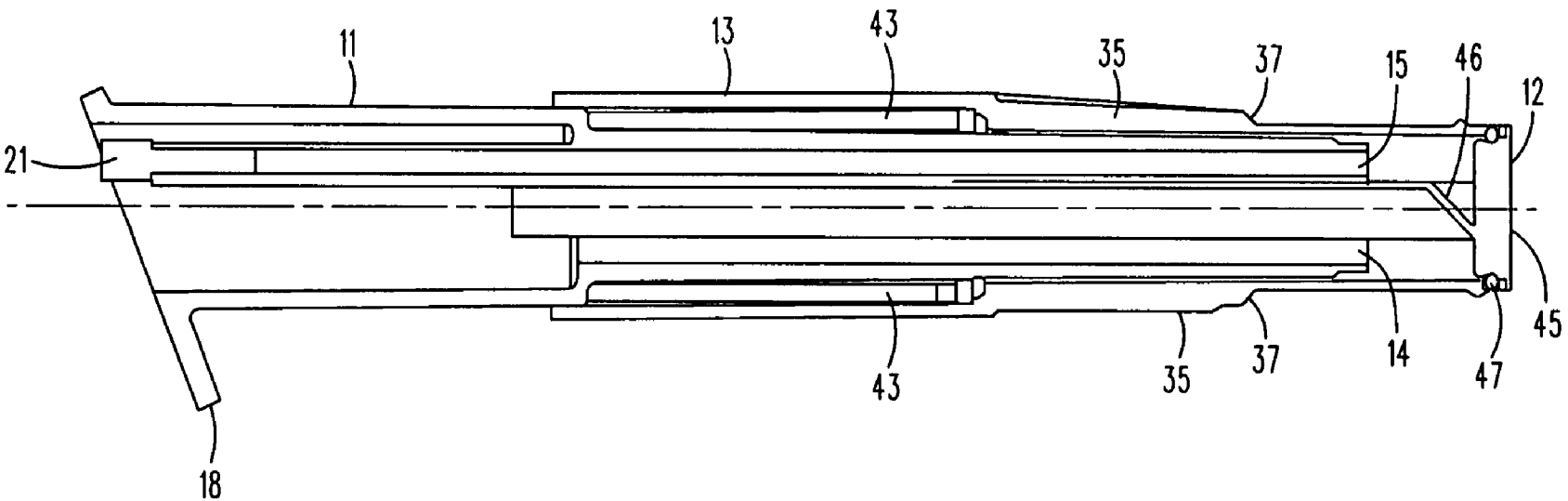
FIG. 21 is a longitudinal sectional view of the pour spout assembly as sectioned through a sagittal plane with the conduit, insert, and sleeve constructions in assembled relation and the pour spout assembly in a closed position.

The assembled pour spout assembly 10 (including components 11-13) is generally depicted and referenced in FIGS. 1, 18-25. The closed position (as generally depicted in FIGS. 20 and 21) functions to prevent matter (such as fuel/fluid and air) from conducting through the first and second conduit chambers 14 and 15, and the open position (as generally depicted in FIGS. 18, 19, 22, and 23) function to permit matter to conduct intermediate the winged end 16 and the dispensing end 25.

Figure 12:
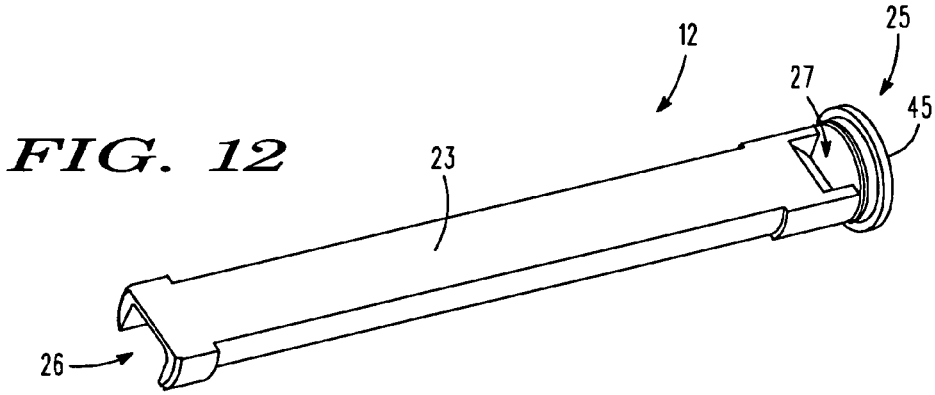
FIG. 12 is a top perspective view of the insert construction showing a substantially planar top portion angled downwardly at a dispensing end thereof.
Figure 13:
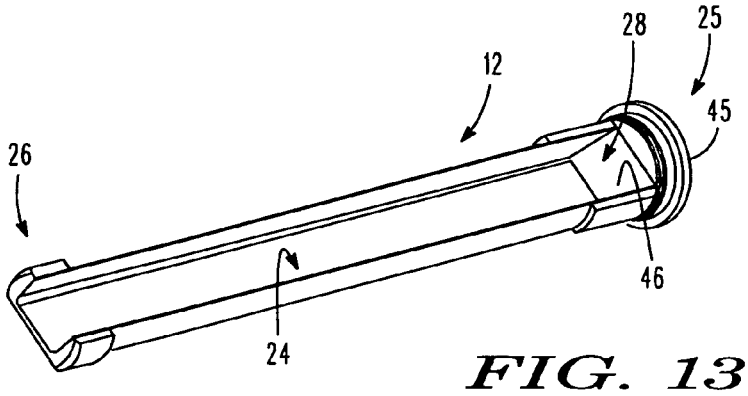
FIG. 13 is a bottom perspective view of the insert construction showing a channeled bottom portion angled upwardly at a dispensing end thereof.

In sum, the spout assembly 10 according to the present invention is designed for transferring fuel/fluid from a container, and comprises a conduit member as at 11, a conduit insert as at 12, and a conduit sleeve as at 13. A first end of the conduit member comprises a laterally extending wing as at 20. The conduit insert comprises a channeled structure as generally depicted in FIGS. 11-13, which channeled structure is angled at one end of the conduit insert as at 46.

The conduit sleeve comprises a first sleeve end having a slot construction for receiving the laterally extending wing of the conduit member at either of first and second slot positions. Further, the outer sleeve construction comprises a plurality of circumferentially spaced wings having transverse and longitudinal termini for providing sleeve stop structure against a fuel/fluid inlet during fuel/fluid transfer.

The conduit sleeve is axially displaceable relative to the conduit member, and the first and second slot positions respectively define a closed position and an open position. The closed position prevent fuel/fluid and air from conducting through the first and second conduit chambers, and the open position permitting fuel/fluid and air to conduct intermediate the first and second conduit ends.

While the foregoing specifications and drawings are set forth in some detail, the specific embodiments described and illustrated thereby are to be considered as exemplifications of the principles of the invention and are not intended to limit the invention(s) to the specific embodiments illustrated. For example, it is contemplated that the present invention essentially comprises a winged conduit member as at 11 and a winged conduit sleeve as at 13.

The winged conduit member essentially comprises first and second conduit ends, the first conduit end comprising a radially extending conduit wing. The winged conduit sleeve further comprises first and second sleeve ends and an intermediate sleeve portion (that portion having ribs or wings 35).

The first sleeve end comprises a slot, and the intermediate sleeve portion comprising a plurality of circumferentially spaced, raised sleeve wings.

The slot is adapted for receiving the conduit wing at first and second slot positions, and the conduit sleeve is axially and rotatably displaceable relative to the conduit member. The conduit wing as received in the first and second slot positions define a closed spout position and an open spout position. The closed position prevents fluid from conducting through the conduit member, and the open position permits fluid to conduct through the conduit member.

Stated another way, the spout assembly according to the present invention functions to transfer fluid from a container, and essentially comprises a conduit member and a conduit sleeve. The conduit member comprises a radially extending conduit wing, and the conduit sleeve comprises a slot and a plurality of circumferentially spaced, raised or extended sleeve wings. The slot is adapted for longitudinally receiving the conduit wing. The conduit sleeve is axially and rotatably displaceable relative to the conduit member such that the conduit wing defines closed and open spout positions.

The conduit sleeve comprises first and second sleeve diameters, the second sleeve diameter being lesser in magnitude relative to the first sleeve diameter. Sleeve wings transversely terminate at wing termini, which wing termini are coextensive with the first sleeve diameter. The sleeve wings further longitudinally terminate for providing spout assembly stop structure at a fuel inlet aperture.

The sleeve construction 13 comprises a slotted end as at 29, a winged end as at 30, and a mid-sleeve portion as at 34. The mid-sleeve portion 34 is substantially midway between the slotted end 29 and the winged end 30. The slotted end 29 preferably comprises bifurcated slot(s) 31 for receiving the conduit wing(s) 20, the bifurcated slot(s) 31 having abbreviated and elongated slot lengths as referenced as respectively referenced at 32 and 33 definable relative to one another.

The sleeve construction 13 receives the basic conduit construction 11 such that the sleeve construction 13 is axially and rotatably displaceable relative to the basic conduit construction 11 intermediate a closed position enabled via the conduit wing(s) 20 and abbreviated slot length(s) 32 and an open position enabled via the conduit wings) 20 and elongated slot length(s) 33.

The slotted end 29 preferably comprises a first sleeve diameter and the winged end 30 preferably comprises a second sleeve diameter such that the second sleeve diameter is lesser in magnitude relative to the first sleeve diameter. The winged end 30 further preferably, comprises a plurality of circumferentially-spaced, longitudinally extending wings 35, which circumferentially-spaced, longitudinally extending wings 35 extend outwardly from the sleeve construction 13 from the mid-sleeve portion 34 toward the terminus of the winged end 30. The circumferentially-spaced, longitudinally extending wings 35 preferably terminate longitudinally substantially midway intermediate the mid-sleeve portion 34 and the winged end 30.

The transverse termini our outer edges of the circumferentially-spaced, longitudinally extending wings 35 at the mid-sleeve portion 34 define a diameter substantially equal in magnitude to the first sleeve diameter. The transverse termini of the circumferentially-spaced, longitudinally extending wings 35 further preferably define a decrementing wing diameter 110 from the mid-sleeve portion 34 toward the longitudinal wing termini of the circumferentially-spaced, longitudinally extending wings 35.

Figures 32, 32A:
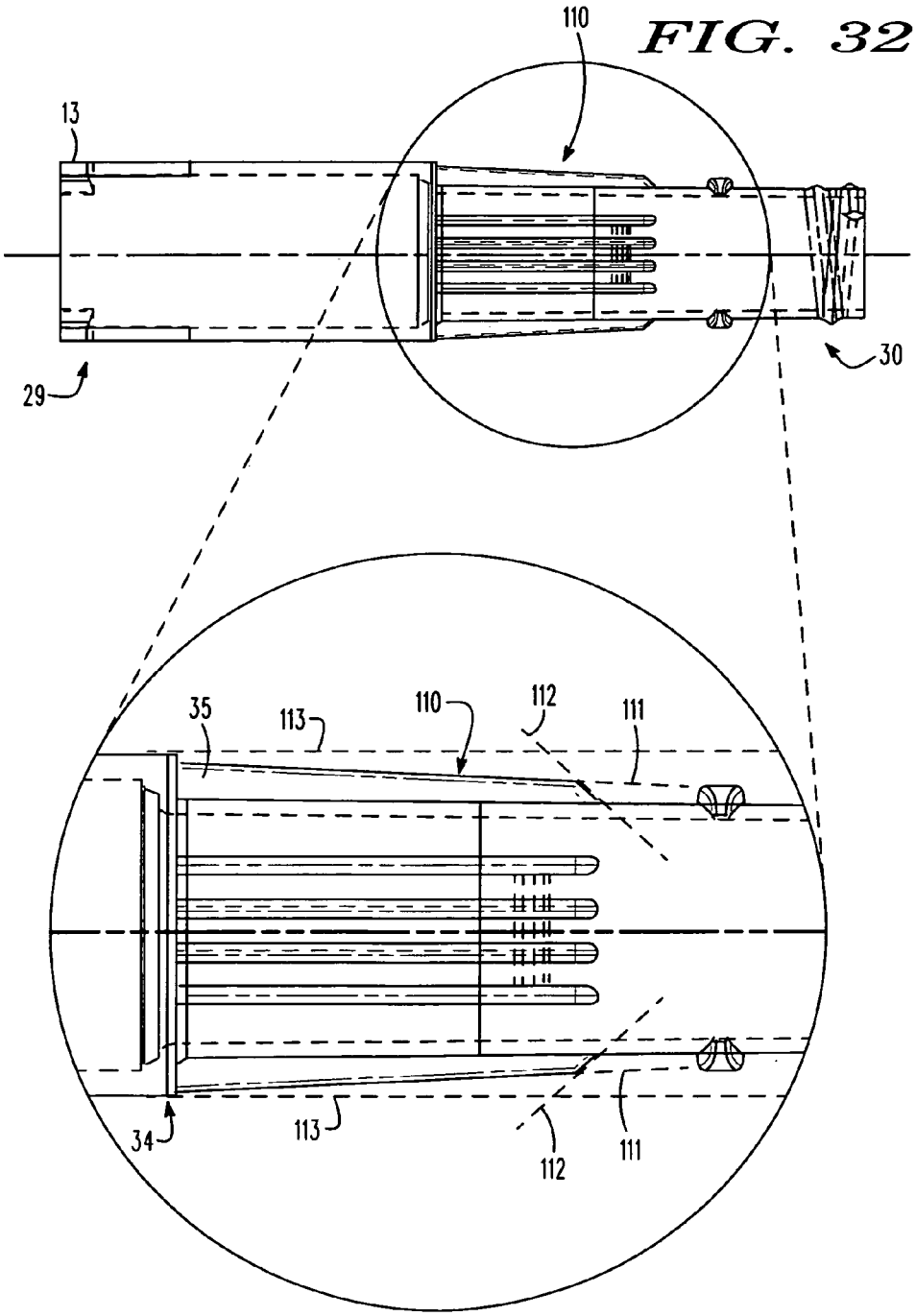
FIG. 32 is a re-presentation of the top plan view of the sleeve construction otherwise shown in FIG. 16, re-presented adjacent FIG. 32(*a*) for clarity of comparison.

In this last regard, the reader is directed to FIGS. 32 and 32(*a*), which figures depict the decrementing wing diameter as at 110. The decrementing wing diameter 110 further defines certain ramped wing structure, which ramped wing structure preferably comprises a first angle of declination as at 111, and a second angle of declination as at 112. The angles of declination 111 and 112 may be measured relative to the planes 113 of the outer surfacing of the slotted end 29.

The sleeve construction 13 further preferably comprises a shoulder as at 41 adjacent the second inner conduit chamber 15. The shoulder 41 circumferentially bridges a first set (as at 120) of circumferentially-spaced, longitudinally extending wings 35 adjacent the longitudinal termini for enhancing spout assembly stop structure adjacent the fuel inlet aperture.

The planes 125 of the first set of circumferentially spaced, longitudinally extending wings 35 are preferably coplanar with the planes 126 of a second set (as at 121) of circumferentially spaced, longitudinally extending wings 35 adjacent the first inner conduit chamber 14. The sleeve construction further preferably comprises an opposed pair (as at 123) of circumferentially spaced, longitudinally extending wings 35.

Figure 33:
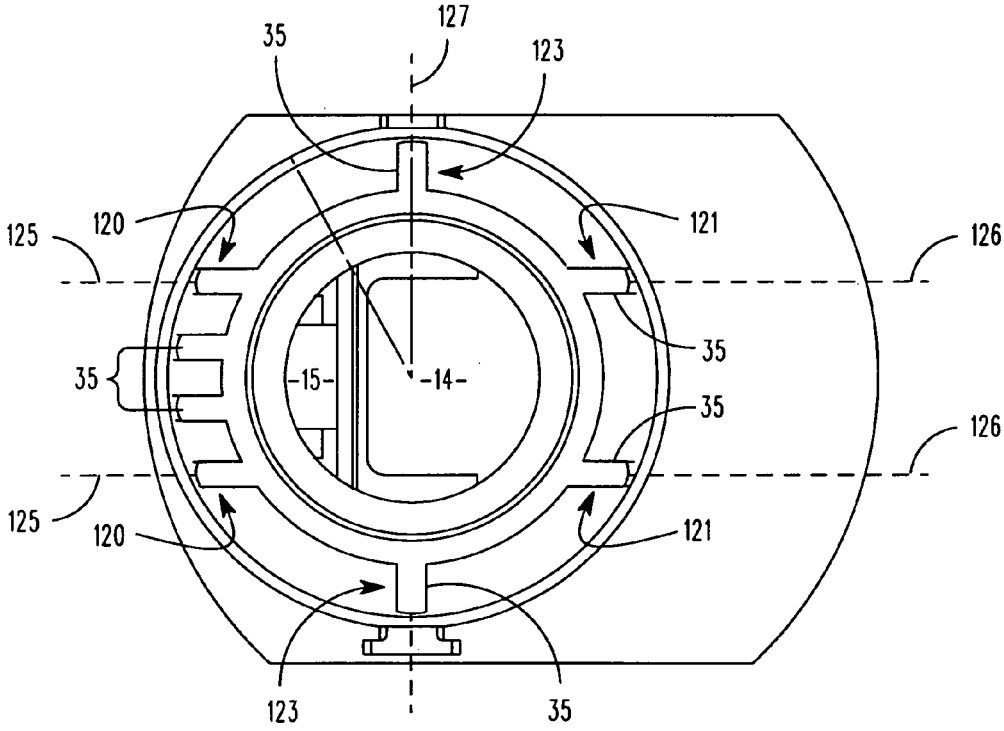
FIG. 33 is an enlarged, re-presented transverse sectional type view of the pour spout assembly otherwise depicted in FIG. 25, and as sectioned along plane '25-25' in FIG. 1, re-presented for clarity to show reference planes of wing structures.

The opposed pair 123 of circumferentially spaced, longitudinally extending wings 35 are preferably orthogonal to the first set 120 and second set 121 of circumferentially spaced, longitudinally extending wines 35. A plane 127 of the opposed pair 123 is angled orthogonally or substantially 90 degrees relative to the coplanar lanes 125 and 126 as may be seen from an inspection of FIG. 33.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

I claim:

1. A spout assembly for transferring fluid from a container, the spout assembly comprising:

a conduit member, the conduit member comprising an extended conduit wing; and a conduit sleeve, the conduit sleeve comprising first and second sleeve ends, a mid-sleeve portion substantially midway between the first and second sleeve ends, a slot and a plurality of planar, circumferentially spaced, extended sleeve wings, the extended sleeve wings extending from the mid-sleeve portion toward the second sleeve end, the slot being adapted for longitudinally receiving the conduit wing, the conduit sleeve being axially and rotatably displaceable relative to the conduit member such that the conduit wing defines closed and open spout positions.

2. The spout assembly of claim 1 wherein the conduit sleeve comprises first and second sleeve diameters, the second sleeve diameter being lesser in magnitude relative to the first sleeve diameter, the circumferentially-spaced, extended sleeve wings extending outwardly from the conduit sleeve from the mid-sleeve portion toward the second sleeve end, the circumferentially-spaced, extended sleeve wings terminating substantially midway intermediate the mid-sleeve portion and the second sleeve end.

3. The spout assembly of claim 2 wherein the circumferentially-spaced, extended sleeve wings transversely terminate at wing termini, the wing termini being coextensive with the first sleeve diameter at the mid-sleeve portion, the wing termini of the circumferentially-spaced, extended sleeve wings defining a decrementing wing diameter from the mid-sleeve portion toward longitudinal wing termini of the circumferentially-spaced, extended sleeve wings, the decrementing wing diameter defining ramped wing structure, the ramped wing structure comprising first and second angles of declination.

4. The spout assembly of claim 3 wherein the circumferentially-spaced, extended sleeve wings longitudinally terminate for providing ramped spout assembly stop structure via a select angle of declination at an inlet aperture, the select angle of declination being selected from the group consisting of the first and second angles of declination.

5. The spout assembly of claim 1 wherein the conduit sleeve comprises a shoulder, the shoulder circumferentially bridging adjacent sleeve wings for providing spout assembly stop structure adjacent an inlet aperture, the planes of the first set of circumferentially spaced, extended sleeve wings being coplanar with the planes of a second circumferentially spaced, extended sleeve wings.

6. The spout assembly of claim 5 wherein the conduit sleeve comprises an opposed pair of circumferentially spaced, extended sleeve wings, the opposed pair of circumferentially spaced, extended sleeve wings being orthogonal to the first and second sets of circumferentially spaced, extended sleeve wings.

7. A spout assembly for transferring fluid from a container, the spout assembly comprising:

a conduit member, the conduit member comprising first and second conduit ends, first and second inner conduit chambers, the first conduit end comprising a radial wing;

a conduit insert, the conduit insert comprising a channel, and first and second insert ends, the conduit insert being insertable into the first inner conduit chamber; and a conduit sleeve, the conduit sleeve comprising first and second sleeve ends, and a mid-sleeve portion, the mid-sleeve portion being substantially midway between the first and second sleeve ends, the first sleeve end comprising a slot construction for receiving the radial wing at first and second slot positions, the conduit sleeve being axially and rotatably displaceable relative to the conduit member, the radial wing as received in the first and second slot positions defining a closed position and an open position.

8. The spout assembly of claim 7 wherein the first sleeve end comprises a first sleeve diameter and the second sleeve end comprises a second sleeve diameter, the second sleeve diameter being lesser in magnitude relative to the first sleeve diameter, the second sleeve end comprising a plurality of planar, circumferentially spaced, longitudinally extending wings, the circumferentially-spaced, longitudinally extending wings extending outwardly from the conduit sleeve from the mid-sleeve portion toward the second end, the circumferentially-spaced, longitudinally extending wings terminating substantially midway intermediate the mid-sleeve portion and the second end.

9. The spout assembly of claim 8 wherein transverse termini of the circumferentially-spaced, longitudinally extending wings at the mid-sleeve portion define a diameter substantially equal in magnitude to the first sleeve diameter, the transverse termini of the circumferentially-spaced, longitudinally extending wings defining a decrementing wing diameter from the mid-sleeve portion toward longitudinal wing termini of the circumferentially-spaced, longitudinally extending wings, the decrementing wing diameter defining ramped wing structure, the ramped wing structure comprising first and second angles of declination.

10. The spout assembly of claim 9 wherein the longitudinal termini provide ramped spout assembly stop structure via a select angle of declination at an inlet aperture, the select angle of declination being selected from the group consisting of the first and second angles of declination.

11. The spout assembly of claim 10 wherein the conduit sleeve comprises a shoulder adjacent the second inner conduit chamber, the shoulder circumferentially bridging a first set of circumferentially-spaced, longitudinally extending wings adjacent the longitudinal termini for enhancing spout assembly stop structure adjacent the inlet aperture, the planes of the first set of circumferentially spaced, longitudinally extending wings being coplanar with the planes of a second set of circumferentially spaced, longitudinally extending wings adjacent the first inner conduit chamber.

12. The spout assembly of claim 11 wherein the sleeve construction comprises an opposed pair of circumferentially spaced, longitudinally extending wings, the opposed pair of circumferentially spaced, longitudinally extending wings being orthogonal to the first and second sets of circumferentially spaced, longitudinally extending wings.

13. A spout assembly for transferring fluid from a container, the spout assembly comprising:

a winged conduit member, the winged conduit member having first and second conduit ends, the first conduit end comprising an extended conduit wing; and a winged conduit sleeve, the winged conduit sleeve comprising first and second sleeve ends and a mid-sleeve portion, the mid-sleeve portion being substantially midway between the first and second sleeve ends, the first sleeve end comprising a slot, the second sleeve end at the mid-sleeve portion comprising a plurality of planar, circumferentially spaced, extended sleeve wings, the slot being adapted for receiving the extended conduit wing at first and second slot positions, the winged conduit sleeve being axially and rotatably displaceable relative to the winged conduit member, the first and second slot positions defining a closed spout position and an open spout position.

14. The spout assembly of claim 13 wherein the first sleeve end comprises a first sleeve diameter and the second sleeve end comprises a second sleeve diameter, the second sleeve diameter being lesser in magnitude relative to the first sleeve diameter, the circumferentially-spaced, extended sleeve wings extending outwardly from the winged conduit sleeve from the mid-sleeve portion toward the second sleeve end, the circumferentially-spaced, extended sleeve wings terminating substantially midway intermediate the mid-sleeve portion and the second sleeve end.

15. The spout assembly of claim 14 wherein the circumferentially-spaced, extended sleeve wings transversely terminate at wing termini, the wing termini being coextensive with the first sleeve diameter at the mid-sleeve portion, the wing termini of the circumferentially-spaced, extended sleeve wings defining a decrementing wing diameter from the mid-sleeve portion toward longitudinal wing termini of the circumferentially-spaced, extended sleeve wings, the decrementing wing diameter defining ramped wing structure, the ramped wing structure comprising first and second angles of declination.

16. The spout assembly of claim 15 wherein the circumferentially-spaced, extended sleeve wings longitudinally terminate for providing ramped spout assembly stop structure via a select angle of declination at an inlet aperture, the select angle of declination being selected from the group consisting of the first and second angles of declination.

17. The spout assembly of claim 13 wherein the conduit sleeve comprises a shoulder, the shoulder circumferentially bridging adjacent sleeve wings for providing spout assembly stop structure adjacent an inlet aperture, the planes of the first set of circumferentially spaced, extended sleeve wings being coplanar with the planes of a second set of circumferentially spaced, extended sleeve wings.

18. The spout assembly of claim 17 wherein the winged conduit sleeve comprises an opposed pair of circumferentially spaced, extended sleeve wings, the opposed pair of circumferentially spaced, extended sleeve wings being orthogonal to the first and second sets of circumferentially spaced, extended sleeve wings.

19. A spout assembly for transferring fluid from a container, the spout assembly comprising:

a basic conduit construction, the conduit construction having first and second inner conduit chambers, a winged end, an insert-receiving end, and a connector flange, the first and second inner conduit chambers being separated by a chamber-separating wall, the winged end comprising a radially extending conduit wing, the connector flange being formed at the winged end;

an insert construction, the insert construction having an insert back portion, a channeled insert front portion, a fluid-dispensing end and a fluid-inletting end, the insert construction being insertable into the first inner conduit chamber such that the insert back portion is attachable to the chamber-separating wall, the insert back portion being angled toward the insert front portion at the dispensing end thereby forming an air inlet and a fluid outlet; and a sleeve construction, the sleeve construction having a slotted end, a winged end, and a mid-sleeve portion, the mid-sleeve portion being substantially midway the slotted end and the winged end, the slotted end comprising a bifurcated slot for receiving the conduit wing, the bifurcated slot having abbreviated and elongated slot lengths definable relative to one another, the sleeve construction receiving the basic conduit construction such that the sleeve construction is axially and rotatably displaceable relative to the basic conduit construction intermediate a closed position enabled via the conduit wing and abbreviated slot length and an open position enabled via the conduit wing and elongated slot length.

20. The spout assembly of claim 19 wherein the slotted end comprises a first sleeve diameter and the winged end comprises a second sleeve diameter, the second sleeve diameter being lesser in magnitude relative to the first sleeve diameter, the winged end comprising a plurality of planar, circumferentially-spaced, longitudinally extending wings, the circumferentially-spaced, longitudinally extending wings extending outwardly from the sleeve construction from the mid-sleeve portion toward the winged end, the circumferentially-spaced, longitudinally extending wings terminating substantially midway intermediate the mid-sleeve portion and the winged end.

21. The spout assembly of claim 20 wherein transverse termini of the circumferentially-spaced, longitudinally extending wings at the mid-sleeve portion define a diameter substantially equal in magnitude to the first sleeve diameter, the transverse termini of the circumferentially-spaced, longitudinally extending wings defining a decrementing wing diameter from the mid-sleeve portion toward longitudinal wing termini of the circumferentially-spaced, longitudinally extending wings, the decrementing wing diameter defining ramped wing structure, the ramped wing structure comprising first and second angles of declination.

22. The spout assembly of claim 21 wherein the longitudinal termini provide ramped spout assembly stop structure via a select angle of declination at an inlet aperture, the select angle of declination being selected from the group consisting of the first and second angles of declination.

23. The spout assembly of claim 22 wherein the sleeve construction comprises a shoulder adjacent the second inner conduit chamber, the shoulder circumferentially bridging a first set of circumferentially-spaced, longitudinally extending wings adjacent the longitudinal termini for enhancing spout assembly stop structure adjacent the inlet aperture, the planes of the first set of circumferentially spaced, longitudinally extending wings being coplanar with the planes of a second set of circumferentially spaced, longitudinally extending wings adjacent the first inner conduit chamber.

24. The spout assembly of claim 23 wherein the sleeve construction comprises an opposed pair of circumferentially spaced, longitudinally extending wings, the opposed pair of circumferentially spaced, longitudinally extending wings being orthogonal to the first and second sets of circumferentially spaced, longitudinally extending wings.

* * * * *